United States Patent [19]

Heynacher

[11] Patent Number: 4,802,309

[45] **Date of Patent: * Feb. 7, 1989**

[54] METHOD AND APPARATUS FOR LAPPING AND POLISHING OPTICAL SURFACES

[75] Inventor: Erich Heynacher, Heidenheim, Fed. Rep. of Germany

[73] Assignee: Carl-Zeiss-Stiftung, Heidenheim, Fed. Rep. of Germany

[ * ] Notice: The portion of the term of this patent subsequent to Aug. 19, 2003 has been disclaimed.

[21] Appl. No.: 82,292

[22] Filed: Aug. 6, 1987

[30] Foreign Application Priority Data

Dec. 22, 1986 [DE] Fed. Rep. of Germany ..... 3643914

[51] Int. Cl.[4] ..... B24B 13/00

[52] U.S. Cl. ..... 51/62; 51/283 R; 51/165.71; 51/67

[58] Field of Search ..... 51/67, 62, 284 R, 283 R, 51/DIG. 34, 141, 325, 58, 165.93, 165.71

[56] References Cited

U.S. PATENT DOCUMENTS

| | | | |
|---|---|---|---|
| 2,399,924 | 5/1946 | Hayward | 51/58 |
| 3,167,889 | 2/1965 | Jacobi | 51/141 |
| 3,676,960 | 7/1972 | Aspden | 51/165.71 |
| 4,512,107 | 4/1985 | Jones | 51/165.93 |
| 4,606,151 | 8/1986 | Heynacher | 51/283 R |

FOREIGN PATENT DOCUMENTS

| | | | |
|---|---|---|---|
| 1437908 | 6/1976 | United Kingdom | 51/141 |

*Primary Examiner*—Frederick R. Schmidt
*Assistant Examiner*—Robert Rose
*Attorney, Agent, or Firm*—Walter Ottesen

[57] ABSTRACT

The workpiece which is moved relative to the tool is processed by a tool configured in the form of a strip-shaped flexible membrane. On the rearward side of the membrane, loading units are arranged with the force of each unit being individually controlled. The pressure distribution exerted by the loading units on the workpiece is varied with time in dependence upon the position of the workpiece. With the method, large optical components such as telescope mirrors and grazing-incidence optical elements for x-ray telescopes can be polished more quickly than by the heretofore known methods. Also non-rotationally symmetrical defects of the surface can be eliminated. An apparatus for carrying out the method of the invention is also disclosed.

10 Claims, 4 Drawing Sheets

Fig. 7
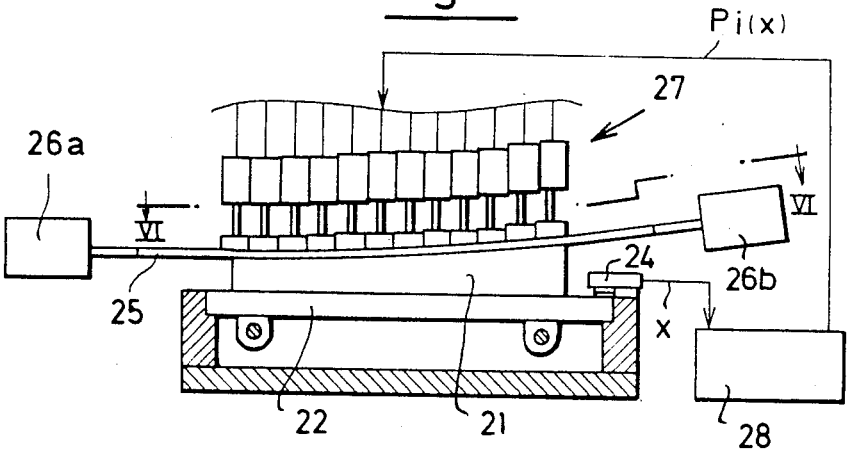
Fig. 8
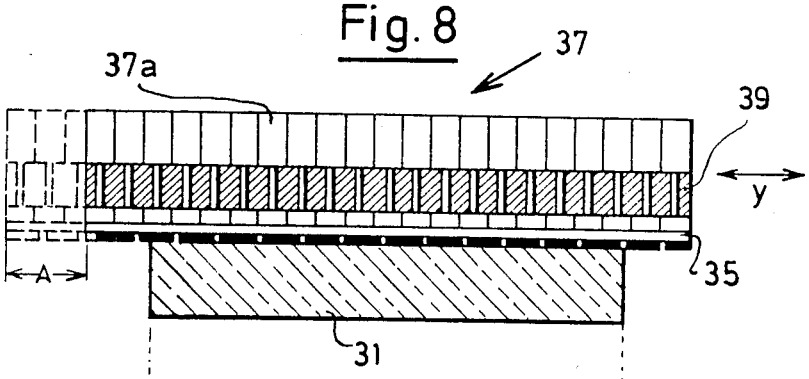
Fig. 9
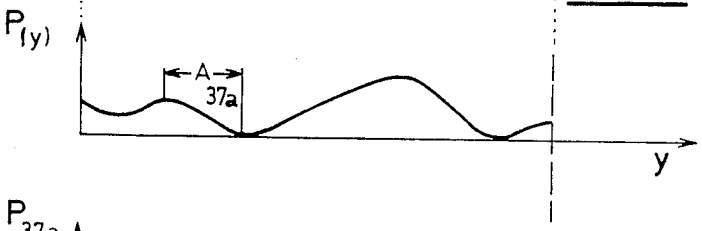
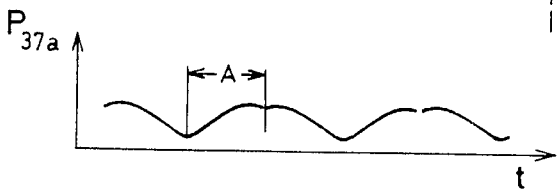
Fig. 10

METHOD AND APPARATUS FOR LAPPING AND POLISHING OPTICAL SURFACES

FIELD OF THE INVENTION

The invention relates to a method and an apparatus for lapping and polishing large optical surfaces such as telescope mirrors, grazing incidence optical components for X-ray telescopes and the like.

Background of the Invention

Lapping and polishing by conventional techniques of relatively large optical members such as are required for astronomical observations are very time-consuming because it is extremely difficult to achieve the desired shape with the required accuracy of fractions of the wavelength of light, typically about 10–50 nm RMS, over the total surface to be worked.

To shorten the work time, an apparatus has already been proposed wherein a tool covering the entire surface of the workpiece to be processed is provided in the shape of a flexible membrane. Moreover, the tool, on whose lower side the polishing elements are fastened, oscillates tangentially over the workpiece under a series of loading units. These loading units are stationary relative to the workpiece and produce a pressure distribution calculated from the deviations of the workpiece from the desired shape.

If desired, these loading units can be moved together with their support laterally relative to the membrane by an amount which is small in comparison to the amplitude of the membrane movement. In this way, the loading units are prevented from impressing the workpiece which, for example, could occur if the stiffness of the membrane is selected as being relatively small.

This apparatus is disclosed in U.S. Pat. No. 4,606,151 which is incorporated by reference herein. With this apparatus it is difficult, nevertheless, to work on very large members such as telescope mirrors with a diameter of four meters or larger because the correspondingly large tool is then difficult to handle. Problems arise, among others, with respect to the metering of the polishing liquid which must always be supplied very uniformly as well as with the preparation of the tool, that is, applying the tool to the workpiece and the pressing of the tool to its proper shape between subsequent working cycles. In addition, large local pressure differences on the rearward side of the tool can cause running of the polishing means carrier, so that the tool deforms rather quickly. This leads to a reduction of the useful dynamics of the polishing process.

Furthermore, with the known apparatus, it is not possible without additional effort to work on grazing incidence optical devices such as conical shells of Wolter telescopes for the X-ray astronomy.

Another polishing apparatus which is similar to that discussed above is disclosed in U.S. Pat. No. 2,399,924. This apparatus also uses a flexible membrane as a tool which extends over the entire surface to be worked upon. This membrane is loaded according to a pressure distribution adapted to a predetermined material removal. With this apparatus, the workpiece to be worked upon is rotated at the same time.

However, with this kind of apparatus, it is only possible to polish away rotationally-symmetrical deviations from the desired shape of the workpiece. Furthermore, it is not possible to eliminate short periodic deviations because the pressure distribution on the rearward side of the tool shifts with the polishing movements relative to the workpiece, since the pressure distribution is produced by weights which rest on the membrane and move with the membrane over the surface to be worked upon.

SUMMARY OF THE INVENTION

It is an object of the invention to provide a method and an apparatus by means of which the above-described disadvantages will be avoided. The method is intended to provide for very short work times and, with respect to the deviations in shape to be eliminated, should be universally applicable to the greatest possible extent.

The method according to the invention is for lapping and polishing a surface of an optical workpiece wherein the contour of the surface to be lapped or polished is first measured and the lapping or polishing process is controlled in correspondence to the deviations of the actual surface contour from a predetermined desired shape. The method of the invention includes the steps of: laying down upon the surface at least one lapping and polishing tool having the form of a strip-like flexible membrane covering only a portion of the surface; applying a plurality of pressure forces to the membrane at a plurality of locations on the side of the membrane facing away from the surface to generate a pressure force distribution corresponding to the deviations, the pressure forces having respective magnitudes which vary as a function of time; imparting an oscillatory movement to the membrane in a predetermined first direction transverse to the pressure forces so as to cause the membrane to move across the surface and to remove material from the surface; moving the workpiece and the tool relative to each other in a predetermined second direction; and, controlling the respective magnitudes of the pressure forces as a function of time in dependence upon the instantaneous relative position between the workpiece and the tool in the second direction of movement in order to correspond to the deviations of that portion of the surface contour covered by the membrane.

The above-described method of the invention is carried out by means of the apparatus of the invention. According to a feature of the apparatus of the invention, a drive introduces a relative movement between the tool and the workpiece in a second direction. The apparatus also includes a position measuring system as well as a controller connected to the position measuring system and to the loading units so that the force applied by the loading units can be varied with reference to this second direction of movement in dependence upon the instantaneous position of the workpiece or the tool.

For rotationally-symmetrical workpieces, it is useful when the movement in the second direction is a rotary movement. The time dependent pressure force distribution is then controlled in dependence upon the rotation angle $\rho$ between the workpiece and the tool. This angle can be determined by an appropriate angle encoder.

However, it is also possible, for example, to mount the workpiece on a carriage which moves linearly and to control the pressure distribution corresponding to the measured values of a length-measuring system connected with the carriage.

One advantage of the method according to the invention is that the strip-shaped tool, because of its relatively smaller size, can be more easily made and handled than a tool covering the entire workpiece.

Further, the differences of the working pressures between individual points on the rearward side of the tool averaged in time, are much smaller than in the case of complete covering of the workpiece. The extent to which the material of the polishing pads can run off is therefore correspondingly smaller. Because of the foregoing, fewer pressing operations are necessary which interrupt the actual polishing process.

Because of the geometry of the tool, the feed of the polishing fluid also can be achieved more easily.

Finally, it has been established that the time required for the actual polishing operation is not increased to the same extent as the surface of the working tool is decreased. The loss of time caused by the partial covering is, instead, compensated for by a faster convergence of the individual, sequentially performed processing cycles, which comprise a plurality of polishing operations, and intermediate measuring operations, wherein the progress of the processing is controlled and the pressure distribution calculated from the deviations is again adjusted. This improved convergence performance can be explained by a smaller embossment of the imperfections of the tool itself on the surface to be worked upon as a result of the averaging of this effect because of the larger degree of relative movement between the tool and the workpiece.

An additional shortening of the processing time can be achieved by utilizing several strip-shaped tools simultaneously to work on the part to be polished.

BRIEF DESCRIPTION OF THE DRAWINGS

The invention will now be described with reference to the drawings wherein:

FIG. 7 is a side-elevation view, partially in section, taken along line VII—VII of FIG. 6;

FIG. 8 is a schematic representation of an alternative embodiment of the tools used in the embodiment of FIGS. 1 and 2 and in the embodiment of FIGS. 6 and 7;

FIG. 9 is a diagram showing the pressure distribution in the direction of movement (y) required for eliminating the residual defects $\Delta Z$ from the surface of the workpiece 31 of FIG. 8; and, FIG. 10 graphically shows the time dependency of the pressure of one of the loading units 37 of FIG. 8.

DESCRIPTION OF THE PREFERRED EMBODIMENTS

Figure 1:
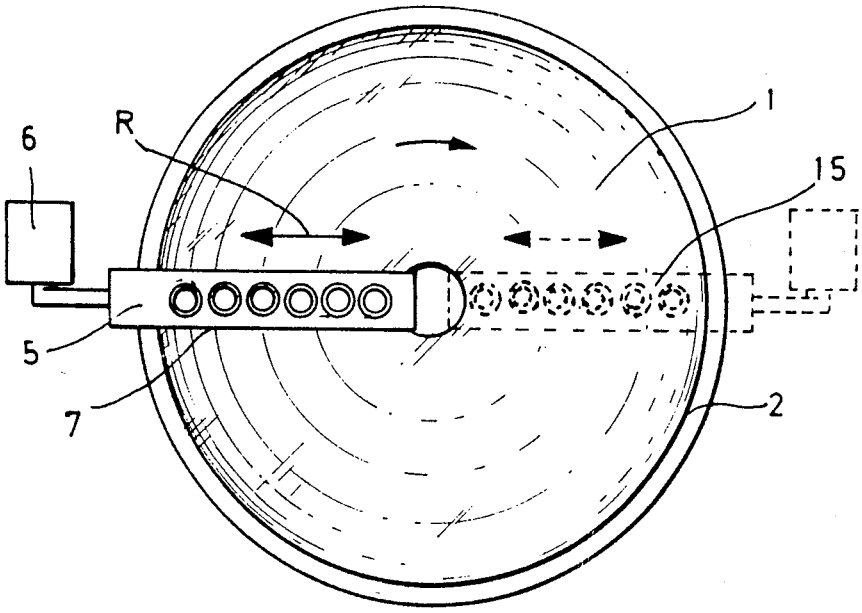
FIG. 1 is a schematic plan view of an apparatus suitable for lapping and polishing astronomical telescopes.
Figure 2:
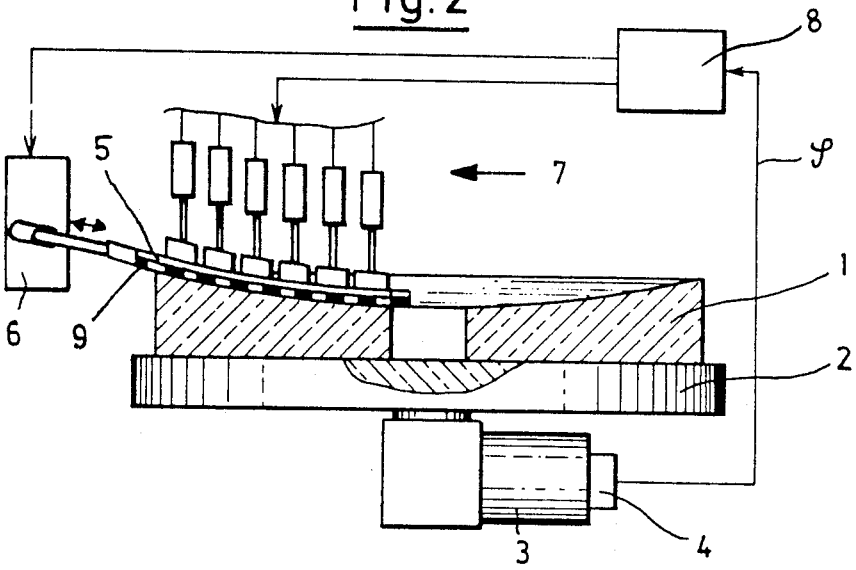
FIG. 2 is a side-elevation view, partially in section of the apparatus of FIG. 1.

The polishing apparatus shown in FIGS. 1 and 2 has a rotatably journaled seat 2 for accommodating the workpiece 1 thereon. The workpiece is, for instance, the main mirror of a telescope for astronomical observations having a diameter of eight meters. The seat 2 is driven by a motor 3 having a shaft on which an encoder 4 is mounted for detecting the angle of rotation.

The polishing tool utilized for working upon the surface of the workpiece comprises a strip-shaped flexible membrane 5 made of aluminum and having a length of five meters and a width of about one meter. Polishing pads 9 made of pitch are applied to the lower side of the membrane. In describing the tool 5 as being a membrane, it should be noted that the membrane for the measurements given above can have a thickness of 1 cm or more throughout. A drive 6 imparts an oscillatory movement to this strip-shaped tool 5 in a radial direction as indicated by the arrow R. The guides along which this movement is effected are not shown in the drawing.

A loading device 7 rests on the rearward side of the membrane 5 and comprises a plurality of loading units radially arranged in a row one behind the other. These loading units are electromagnetically or hydraulically controlled actuators of the kind described, for example, in U.S. Pat. No. 4,606,151 referred to above and incorporated herein by reference. The loading device 7 remains stationary relative to the workpiece 1 and does not take part in the oscillatory movement of the membrane 5.

The individual loading units of the loading device 7 are individually charged with a force by means of a control unit 8 calculated from the measured deviations of the surface of the mirror 1 from the desired shape. The pressure force applied by each individual actuator of the device 7 thus can be varied in time in dependence upon the azimuthal angle which is reported by the encoder 4 to the control instrument 8. Correspondingly, non rotationally-symmetrical defects will also be attacked during the polishing or lapping process. The prerequisite for this process is that the azimuthal pattern of the defects on the mirror surface is determined and stored in the memory of the computer connected to the control unit 8.

It is entirely possible to work on the mirror simultaneously with several tools as indicated in FIG. 1 by the tool 15 represented in phantom outline.

Figure 3:
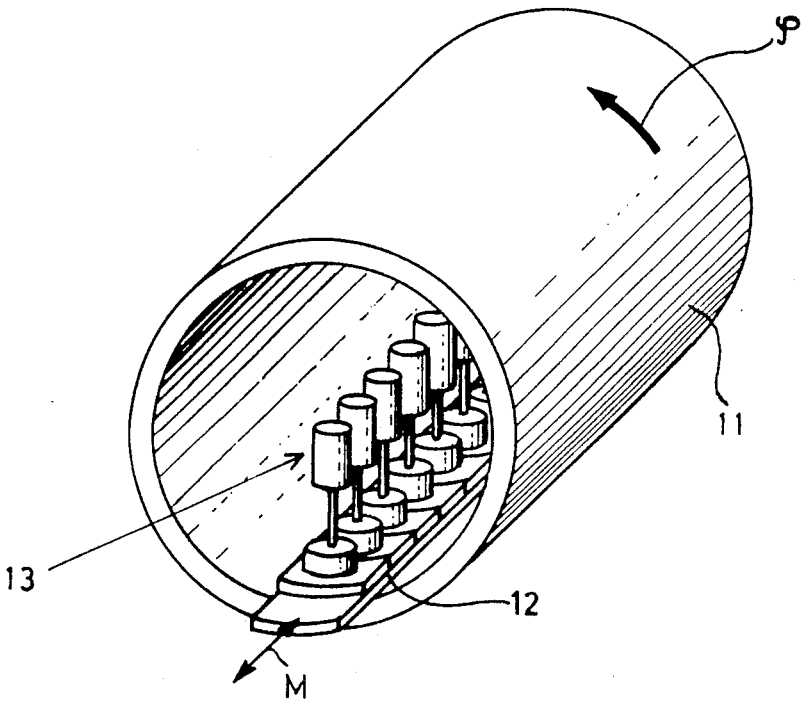
FIG. 3 is a perspective view showing the application of the method according to the invention to a grazing incidence optical component.

FIG. 3 is a perspective representation to show how the method of the invention can be adapted to work upon a grazing incidence optical workpiece. Here reference numeral 11 indicates a conical shell of a Wolter telescope having an inner surface which must be polished. For polishing, a strip-shaped tool 12 is utilized which oscillates along the generating line of the cone 11. This oscillatory movement is represented by the arrow M in FIG. 3. The conical shell 11 itself rotates about its longitudinal axis.

Inside the conical shell 11, a series of actuators 13 rest on the rearward side of membrane 12 each applying individually an adjustable and time varying force in dependence upon the rotation angle $\rho$ of the shell 11. The actuators 13 do not take part in the oscillatory movement of the membrane 12; instead, they are mounted to remain stationary with respect to the direction of the generating line of the cone or perform an independent movement with smaller amplitude and frequency compared to the movement of the membrane 12 in a direction perpendicular to the direction of membrane movement.

Figure 4:
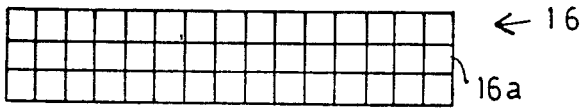
FIG. 4 is a schematic representation of another embodiment of the strip-shaped tool utilized in the apparatus of the invention shown in FIGS. 1 and 2 and in FIG. 3.

In both embodiments of the invention according to FIGS. (1, 2) and FIG. 3, the loading device 7 or 13, respectively, has only one row of actuators arranged on the rearward side of each of the strip-shaped members 5 and 12. This is not, however, absolutely required. It is quite advantageous to control simultaneously several rows of actuators, arranged one behind the other, and loading one membrane. With the total surface of the tool being predetermined, this allows also attacking deviations of the workpiece surface having a relatively high spatial frequency. This case is illustrated in FIG. 4. The tool 16 shown there has 45 actuators, arranged in three rows, each with 15 individual units 16*a* loading on the rearward side of the movable membrane.

It also is not required that the tool or the surface to be worked upon be moved during its rotation through a closed circle. In particular, for processing workpieces which represent segments or sections of a complete mirror, a movement should be provided which reverses itself at the edges of the workpiece, that is, a back and forth or reciprocating rotational movement wherein also the time dependent signal controlling the pressure force distribution pattern reverses itself.

Figure 5:
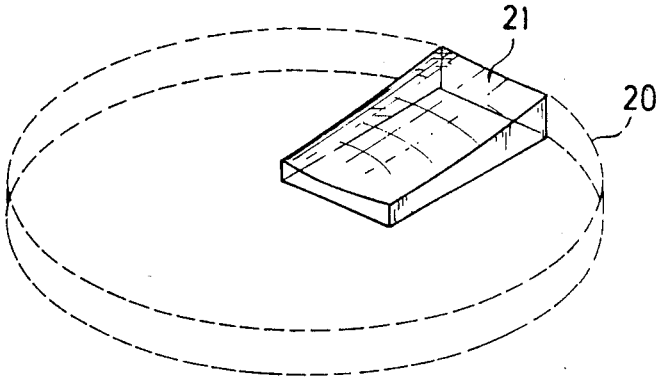
FIG. 5 is a perspective view of a non-rotationally symmetrical workpiece to be processed in accordance with the method of the invention.

When dealing with the above-described kinds of segments which, like the part 21 of the complete mirror 20 shown in FIG. 5, either have rectangular boundaries or have a spacing to the center of the circle which is relatively large, then it is useful to provide a linear movement instead of a rotational movement between workpiece and tool.

Figure 6:
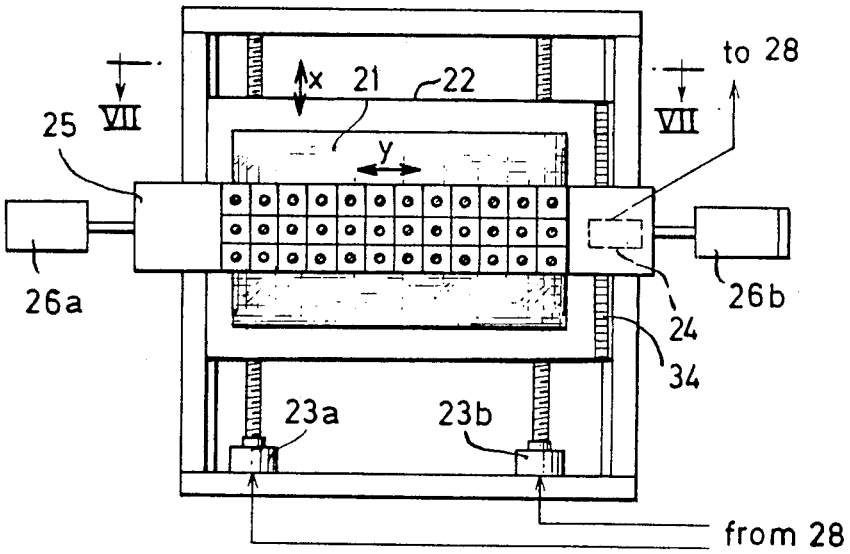
FIG. 6 is a plan view of an apparatus suitable for lapping and polishing the workpiece of FIG. 5 taken along line VI—VI of FIG. 7.

This case will be explained below with reference to FIGS. 6 and 7. Here, the workpiece 21 to be lapped is placed on a carriage 22 guided for linear movement with respect to the axis (x). This carriage 22 is set into a reciprocating movement by means of drives 23*a* and 23*b* which act upon threaded spindles. The instantaneous position of the carriage along axis (x) is established by a reading head 24 of a scale 34 attached to the carriage.

A processing tool in the form of a strip-shaped membrane 25 lies upon the workpiece 21. The membrane 25 is set into an oscillatory movement perpendicular to the direction of the movement of the carriage by means of two drives 26*a* and 26*b*. As in the embodiment of FIGS. 1 and 2, also here a loading device 27 comprising a plurality of closely packed actuators with adjustable force are supported on the rearward side of the membrane 25. The actuators are, for example, arranged in 3 rows with each row containing 12 units.

The pressure force $P_i$ of the individual actuators 27 is controlled by a control unit 28 in dependence upon the position of the carriage 22 in the x-direction, which the reading head 24 of the length measuring system reports to the control unit 28. For this purpose, values of the pressure $P_i$ are assigned to each position which are determined beforehand from the deviation pattern of the mirror surface in the x-direction and are stored in the memory of a computer attached to the control unit 28.

In the above-described embodiments, the actuators for producing the pressure force are in each case stationary, while the actual processing tool, the strip-shaped membrane (5 or 25) oscillates between the actuators and the surface of the workpiece.

However, for structural reasons, it can be useful if the membrane 35 and actuators 37 shown in FIG. 8 are united to define a tool 39 and conjointly move in the longitudinal direction (y) of the strip. In this case, the time dependent pressure force distribution pattern of the actuators should, however, be controlled not only according to the pattern of deviations $\Delta Z$ of the workpiece surface 31 extending in one coordinate (linear or rotational), but also the deviation pattern extending in the direction of movement (y) of the tool must be taken into consideration; that is, the pressure of the actuators must be controlled at each time point in dependence upon the position of each individual actuator with respect to both coordinates on the surface of the workpiece. Only in this way can the condition be obtained that the pressure distribution P(y), remains constant during the course of the processing operation with respect to this direction of movement of the tool relative to the workpiece. The pressure distribution P(y) is calculated in correspondence to the deviations of the workpiece 31 from the desired shape and is illustrated by way of example in FIG. 9.

Onto the pressure function P(x) or $P(\alpha)$ with which the actuators 37 are loaded in correspondence to the movement of the workpiece 31 in one direction as illustrated in FIGS. (1, 2) and (5, 6), also must be superimposed a second pressure function corresponding to the variation of the processing deviations within the amplitude (A) of the movement of each actuator in the y-direction.

Should this last-mentioned oscillatory movement of the workpiece 39 occur sufficiently fast in comparison to the workpiece 31, a time dependent representation as shown, for example, in FIG. 10 is obtained for the pressure of the actuator 37*a* of FIG. 8.

It is understood that the foregoing description is that of the preferred embodiments of the invention and that various changes and modifications may be made thereto without departing from the spirit and scope of the invention as defined in the appended claims.

What is claimed is:

1. A method of lapping and polishing a surface of an optical workpiece, wherein the contour of the surface to be lapped or polished is first measured and the lapping or polishing process is controlled in correspondence to the deviations of the actual surface contour from a predetermined desired shape, the method comprising the steps of:

laying down upon said surface at least one lapping and polishing tool having the form of a strip-like flexible membrane covering only a portion of said surface;

applying a plurality of pressure forces to said membrane at a plurality of locations on the side of the membrane facing away from said surface to generate a pressure force distribution corresponding to said deviations, said pressure forces having respective magnitudes which vary as a function of time;

imparting an oscillatory movement to said membrane in a predetermined first direction transverse to said pressure forces so as to cause said membrane to move across said surface and to remove material from said surface;

moving said workpiece and said tool relative to each other in a predetermined second direction; and, controlling the respective magnitudes of said pressure forces as a function of time in dependence upon the instantaneous relative position between said workpiece and said tool in said second direction of movement in order to correspond to the deviations of that portion of said surface covered by said membrane.

2. The method of claim 1, comprising laying down a plurality of said tools upon said surface and imparting respective oscillatory movements thereto.

3. The method of claim 1, wherein said movement in said second direction is a rotational movement and wherein the respective magnitudes of said pressure forces are controlled in dependence upon the angle $\rho$ of rotation between said tool and said workpiece.

4. The method of claim 1, wherein said movement in said second direction is a linear movement along an axis (x) and wherein the respective magnitudes of said pressure forces are controlled in dependence upon the relative position between said tool and said workpiece along said axis (x).

5. The method of claim 1, wherein said pressure forces are generated by a plurality of loading units which are moved with said membrane in said first direction thereby holding the pressure force distribution constant in said first direction; and, wherein the magnitudes of the respective pressure forces of said loading units are also controlled in dependence upon their instantaneous positions along said first direction of movement.

6. An apparatus for lapping or polishing a surface of an optical workpiece, wherein a tool is controlled in correspondence to the deviations of the actual surface contour from a predetermined desired shape, the apparatus comprising:

a tool having the form of a strip-like flexible membrane with first and second sides, said membrane being adapted to cover only a portion of said surface and carrying a lapping or polishing base on said first side;

a loading device including a plurality of loading units for applying respective forces to said second side of said membrane thereby generating a strip-like pressure force distribution;

first drive means for imparting an oscillatory movement to said membrane in a first direction transverse to the forces of said loading device;

second drive means for imparting a relative movement between said workpiece and said loading device in a second direction;

position indicating means operatively connected to said second drive means for indicating the relative position between said loading device and said workpiece; and, control means connected o said position indicating means and to said loading device for individually controlling the magnitude of each of said forces in correspondence to the deviations of the portion of said surface covered by said membrane.

7. The apparatus of claim 6, said second drive means being a rotational drive for imparting a relative rotational movement between said workpiece and said loading device; and, said position indicating means being an angle encoder.

8. The apparatus of claim 6, said second drive means being a linear drive for imparting a relative linear movement between said workpiece and said loading device; and, said position indicating means being a length measuring system.

9. The apparatus of claim 6, said membrane and said loading device being connected to each other for common oscillatory movement in said first direction; and, said control means including means for controlling the magnitude of each of said forces so as to maintain the pressure force distribution constant with respect to said workpiece in said first direction of movement.

10. The apparatus of claim 6, wherein the loading units are arranged in a plurality of mutually adjacent rows, each row extending in said first direction of movement.

* * * * *

UNITED STATES PATENT AND TRADEMARK OFFICE

CERTIFICATE OF CORRECTION

PATENT NO. : 4,802,309

DATED : February 7, 1989

INVENTOR(S) : Erich Heynacher

It is certified that error appears in the above-identified patent and that said Letters Patent is hereby corrected as shown below:

In column 2, line 60: delete "ρ" and substitute -- $\varphi$ -- therefor.

In column 4, line 60: delete "ρ" and substitute -- $\varphi$ -- therefor.

In column 6, line 18: delete "P(α)" and substitute -- P(α), -- therefor.

In column 7, line 7: delete "ρ" and substitute -- $\varphi$ -- therefor.

In column 8, line 11: delete "o" and substitute -- to -- therefor.

Signed and Sealed this

Twenty-sixth Day of September, 1989

*Attest:*

DONALD J. QUIGG

*Attesting Officer*

*Commissioner of Patents and Trademarks*